United States Patent [19]

Rambow

[11] Patent Number: 4,698,911

[45] Date of Patent: Oct. 13, 1987

[54] METHOD OF USING A BOREHOLE TELEVIEWER DIPMETER FOR DETERMINING TRUE DIP AND AZIMUTH

[75] Inventor: Frederick H. K. Rambow, Houston, Tex.

[73] Assignee: Shell Oil Company, Houston, Tex.

[21] Appl. No.: 810,624

[22] Filed: Dec. 19, 1985

[51] Int. Cl.[4] ..... G01V 3/18

[52] U.S. Cl. ..... 33/302; 33/313; 367/69

[58] Field of Search ..... 33/304, 302, 313, 312, 33/314, 301; 367/69

[56] References Cited

U.S. PATENT DOCUMENTS 3,127,509 3/1964 Swift ..... 33/313 X 3,369,626 2/1968 Zemanek ..... 367/69

*Primary Examiner*—William D. Martin, Jr.

[57] ABSTRACT

A method for determining the true dip and azimuth of bedding planes in a formation penetrated by a borehole using borehole televiewer measurements. The method corrects for borehole deviation and for inclination of the earth's magnetic field.

11 Claims, 12 Drawing Figures

BHTV BEDDING DISPLAY
TIME-OF-FLIGHT

BHTV BEDDING DISPLAY
AMPLITUDE

FROM FIG. 7A

INPUT APPARENT DIP AZIMUTH, $\emptyset$, MEASURED CLOCKWISE FROM NORTH AS INDICATED BY BHTV LOG

CALCULATE APPARENT DIP AZIMUTH WITH RESPECT TO THE LOW SIDE OF THE BOREHOLE $$\gamma = \theta_P - \text{APPARENT DIP AZIMUTH}$$

DETERMINE ROTATION MATRIX, $R_C(\gamma)$, FROM BOREHOLE FRAME OF BHTV $(N'', W', V')$ TO FRAME ALIGNED WITH DIP AZIMUTH $(N''', W'', V')$ INPUT APPARENT DIP, $\Psi$, AS MEASURED IN BOREHOLE FRAME BY BHTV DETERMINE ROTATION MATRIX, $R_D(\Psi)$, FROM $(N''', W'', V')$ TO $(N'''', W'', V'')$ FRAME WITH AXES ALONG BEDDING DIP, STRIKE, AND NORMAL, RESPECTIVELY.

CALCULATE THE COMPOSITE ROTATION MATRIX, $R_t$, FROM EARTH REFERENCE FRAME, $(N, W, V)$ TO $(N'''', W'', V'')$ WITH ELEMENTS $A_{ij}$ $$R_t = R_A \cdot R_B \cdot R_C \cdot R_D$$

CALCULATE TRUE DIP IN EARTH REFERENCE FRAME, $(N, W, V)$ AS $$\text{TRUE DIP} = \cos^{-1}(A_{33})$$

CALCULATE TRUE DIP AZIMUTH IN EARTH REFERENCE FRAME, $(N, W, V)$ AS $$\text{TRUE DIP AZIMUTH} = \tan^{-1}\left(\frac{A_{32}}{A_{31}}\right)$$

FIG. 7B

METHOD OF USING A BOREHOLE TELEVIEWER DIPMETER FOR DETERMINING TRUE DIP AND AZIMUTH

BACKGROUND OF THE INVENTION

The present invention relates to borehole logging instruments, and more particularly to the use of a borehole televiewer ("BHTV") as a dipmeter. Such a televiewer is described in U.S. Pat. No. 3,369,626, where the use thereof as a dipmeter is also suggested. The term "dipmeter" is used to refer to instruments that measure the dip angle of a bedding or fracture plane and the azimuth of the plane. Normally, the angle between the bedding or fracture plane and horizontal is referred to as the dip (or dip angle) of the plane, and the dip azimuth is measured with respect to geographic north by a line (sometimes called the "strike" of the plane) which is the line of intersection of a horizontal plane and the bedding or fracture plane, and is normal to the dip.

Conventionally, the dip and dip azimuth of the plane have been determined by a four arm electrical logging device that measures the resistivity of the various formations through which it passes. The resistivity is determined by each of the individual arms and separately recorded together with the orientation of one of the arms with respect to geographic or magnetic north. With this information and knowing the deviation or inclination of the borehole at the depth of interest and the azimuth of the deviation, one can calculate the dip and azimuth of the bedding or fracture plane. While this type of dipmeter has been conventionally used for many years, it cannot generally operate in boreholes filled with oil-based mud. Of course, if it is possible to replace the oil-based mud with a water-based mud without damaging the formation, then one can usually obtain electrical logging information.

Conventional dipmeter instruments also fail in those formations where the resistivity contrasts between the formations on one side of the bedding or fracture plane and the formations on the other side are not great enough to produce appreciable differences in the resistivity as measured by the instrument.

A need therefore remains for an improved method for logging the true dip angle and azimuth of earth formations using a borehole televiewer. A particular need remains for a method for logging the dip and dip azimuth of such formations in boreholes which are filled with an oil-based mud. Such a method should be sensitive, accurate, and should readily compensate for the adverse effects of borehole deviation and the dip inclination of the earth's magnetic field.

SUMMARY OF THE INVENTION

The present invention solves the above problems by using a borehole televiewer as a bed dip measuring device, i.e., a dipmeter. The method consists of first running a conventional BHTV log in the borehole. In addition to running the log, the inclination and azimuth of the borehole are determined. This can be done simultaneously, or may consist of a separate measurement made by suitable borehole survey instruments.

While obtaining the log, the BHTV data is recorded and also displayed in a conventional graphic form wherein the map of the borehole wall appears to be unrolled and the left hand edge indicates magnetic north as determined by the instrument. Since borehole televiewers are ordinarily centralized in the borehole, the plane of the BHTV will ordinarily be normal to the major axis of the borehole.

The invention then computes the projection of the earth's magnetic vector on the plane of the borehole televiewer at the particular depth interval of interest. As is described, for example, in U.S. Pat. No. 3,478,839, the earth's magnetic field or vector does not lie in a horizontal plane in all areas of the world. In many cases, it can dip at substantially large angles from the horizontal (approximately 60 degrees, for example, in Houston, Tex.). Conventional BHTV instruments utilize a rotating fluxgate magnetometer to determine the position of magnetic north. The fluxgate magnetometer responds to the projection of the earth's magnetic vector onto the plane of the magnetometer (which is usually the plane of the BHTV), and corrections must therefore be made for the inclination angle of the magnetic vector. This angle can be measured by suitable equipment (e.g., 3 component magnetometers), or read from magnetic direction and magnitude maps such as published by the USGS and the Bureau of Standards.

After the correct azimuth or magnetic north is determined, the apparent change in depth of the bedding or fracture plane as a function of apparent azimuth is taken visually from the BHTV log. This can be easily done by using light pens or similar devices that have been developed for computers wherein the low and high points of the sinusoidal curve representing the plane can be determined, as well as the approximate azimuth of the low point. From this information the programmed computer then calculates the true dip and azimuth of the bedding or fracture plane.

In a preferred embodiment of the invention, therefore, a BHTV log of the formation is obtained, the deviation and deviation azimuth of the portion of the borehole that penetrates the formation are determined with respect to the earth's reference frame, the earth's magnetic inclination in the vicinity of the borehole is determined, and the dip and dip azimuth of the bedding or fracture plane in the borehole reference frame are computed utilizing the BHTV log measurement. This information is then used to compute the true dip and dip azimuth of the bedding or fracture plane in the earth's reference frame by using Euler angle techniques, i.e. a pre-determined series of matrix rotations.

First the axes of the earth's reference frame are rotated to a new set of orthogonal axes which include one axis lying along the strike of the bedding or fracture plane, one lying in the bedding or fracture plane and defining the dip direction thereof, and one perpendicular to the bedding or fracture plane. In the preferred embodiment, this is accomplished by first performing three rotations which effectively rationalize the earth's north, west, vertical and magnetic vectors into three orthogonal vectors two of which lie in and define the plane of the borehole while the third lies along the axis of the borehole. One of the vectors in the plane of the borehole also preferably points toward the low side thereof. Two more rotations are then performed to define a final set of orthogonal vectors having a pair in the bedding or fracture plane, one lying along the strike thereof and the other defining the dip direction thereof, and a third vector which is perpendicular to the plane. From these, the actual true dip and azimuth of the formation, in the earth's reference frame, are thereby readily and accurately specified.

According to the present invention, therefore, the results of the BHTV measurements are expressed in terms of the equivalent rotated coordinates of the earth's reference frame. Knowing these, the true dip and dip azimuth can be directly specified in terms of the earth's reference frame since the actual specific vector rotations which brought the earth's coordinates into the actual plane of the formation have been determined. By this means a heretofore unresolved deficiency in prior art formation logging has been overcome.

It is therefore an object of the present invention to provide an improved borehole televiewer, and in particular an improved method for performing dip meter measurements of earth formations therewith; such a method which will furnish accurate and correct information regarding the true dip and azimuth of a formation bedding plane or fracture plane specified in the earth's reference frame; in which the logging operation and measurements can be performed regardless of the fluid in the borehole; in which a conventional BHTV log is obtained of the formation; in which the deviation and deviation azimuth of the portion of the borehole that penetrates the formation is determined with respect to the earth's reference frame; in which the earth's magnetic inclination in the vicinity of the borehole is determined; in which the BHTV log measurements are utilized to compute the dip and dip azimuth of the bedding or fracture plane in the borehole reference frame; in which the computed dip and dip azimuth of the bedding or fracture plane, the deviation and deviation azimuth of the borehole portion, and the earth's magnetic inclination are then utilized to compute the true dip and dip azimuth of the bedding or fracture plane in the earth's reference frame; and to accomplish the above objects and purposes in an efficient, uncomplicated, versatile, reliable, and accurate method readily suited to the widest possible utilization in the logging of earth formations penetrated by a borehole.

BRIEF DESCRIPTION OF THE DRAWINGS

The invention will be more easily understood from the attached drawings, wherein:

FIGS. 7A and 7B are flow charts of a preferred computational method for use in performing the invention.

DESCRIPTION OF THE PREFERRED EMBODIMENT

Figure 1:
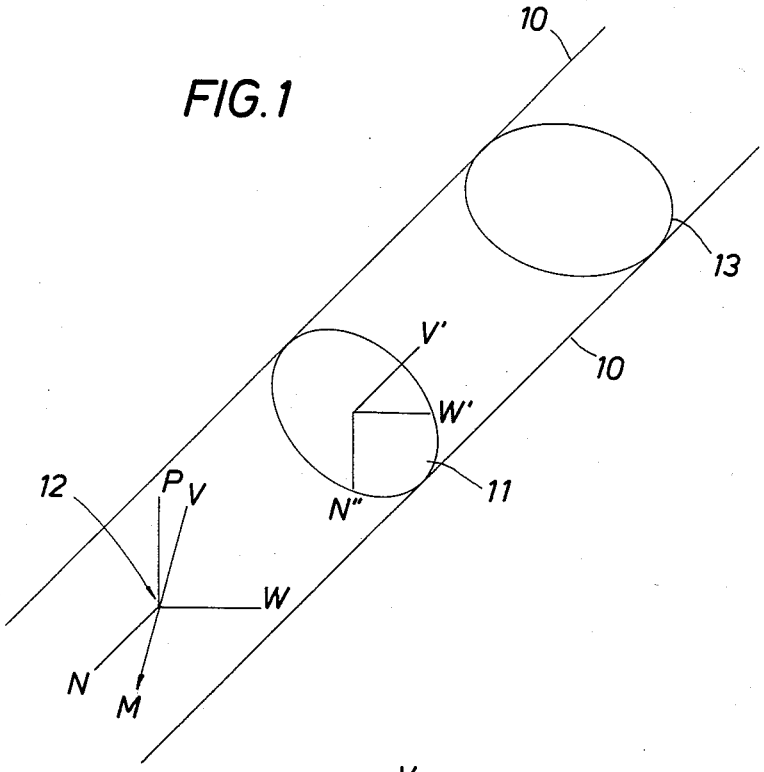
FIG. 1 is a visual representation of the earth's magnetic field and the BHTV in an inclined or deviated borehole.

Referring now to FIG. 1, there is shown a borehole represented by the two lines 10, the plane of the BHTV at 11, and the earth's coordinate system (N,W,V) and magnetic vector coordinate system (M,W,P) at 12. The fluxgate magnetometer compass (not shown) in the BHTV lies in or parallel to plane 11. The intersection of a bedding plane and the borehole is shown by the ellipse 13.

Figure 2A:
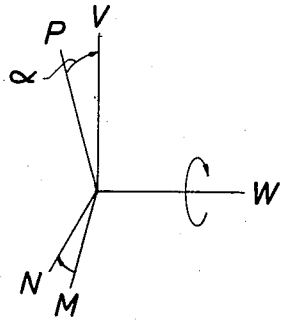
FIGS. 2A–2C represent a series of rotations for rotating the axes of the earth's reference frame to the axes of the BHTV in the borehole, and for determining the projection of the earth's magnetic field onto the plane of the BHTV.

Referring now to FIG. 2A, there is shown the orthogonal north $\vec{N}$ and west $\vec{W}$ vectors of the earth as well as a vertical $\vec{V}$ vector which is orthogonal to both the north and west directions. The $\vec{N}$ and $\vec{W}$ vectors thus define a plane parallel to the earth's horizon at the top of the borehole 10. This plane is referred to herein as the "earth's reference frame". The earth's magnetic vector $\vec{M}$ projects downwardly (in the northern hemisphere) at some angle with respect to the horizon known as the magnetic inclination while the vector $\vec{P}$ is orthongonal to the earth's magnetic vector $\vec{M}$ and to the $\vec{W}$ vector. The BHTV plane 11 (FIG. 1) is defined by orthogonal vectors $\vec{N}''$ (which points to the low side of the borehole) and $\vec{W}'$ which extend radially in borehole 10, and by vector $\vec{V}'$ which is parallel to the major axis of the borehole at that location and orthogonal to vectors $\vec{N}''$ and $\vec{W}'$. As explained above, in the preferred embodiment of the invention, the projection of the earth's magnetic vector $\vec{M}$ onto the plane 11 of the BHTV will be determined in order to derive a compass correction and to obtain the angle between magnetic north as measured by the BHTV and true magnetic north.

To determine the projection of the magnetic vector $\vec{M}$ onto the plane of the BHTV compass, a series of three rotations is made. FIG. 2A shows the first rotation about the west vector or axis $\vec{W}$ through the angle $\alpha$. This in effect rotates both the magnetic vector axis $\vec{M}$ and the $\vec{P}$ axis into alignment with the $\vec{N}$ and $\vec{V}$ axes respectively. (See for example sections 14.6 and 14.10 of Mathematical Handbook for Scientists and Engineers-Second Edition, by Granino A. Korn and Theresa M. Korn, published by McGraw-Hill, 1968.) The rotation can be described by the following matrices:

First Rotation:

$$\begin{pmatrix} \vec{N} \\ \vec{W} \\ \vec{V} \end{pmatrix} = \begin{pmatrix} \cos\alpha & 0 & \sin\alpha \\ 0 & 1 & 0 \\ -\sin\alpha & 0 & \cos\alpha \end{pmatrix} \cdot \begin{pmatrix} \vec{M} \\ \vec{W} \\ \vec{P} \end{pmatrix} = R_M \cdot \begin{pmatrix} \vec{M} \\ \vec{W} \\ \vec{P} \end{pmatrix} \quad (1)$$

where:

$\vec{M}$ lies along the earth's magnetic field vector, $\vec{W}$ is horizontal and points west, $\vec{P}$ is mutually orthogonal to $\vec{M}$ and $\vec{W}$ and its direction is defined by the cross product of $\vec{M} \times \vec{W}$, $\vec{N}$ lies along the horizontal north component, $\vec{W}$ is unchanged, $\vec{V}$ is vertical.

The angle $\alpha$ is defined as the angle of magnetic field inclination. (Inclination data may be obtained from such sources as: Magnetic Inclination in the United States-Epoch 1975.0 by Norman Peddie, William J. Jones and Eugene B. Fabiano. This is a map published by the Dept. of Interior, USGS, Map 1-912.)

Figure 2B:
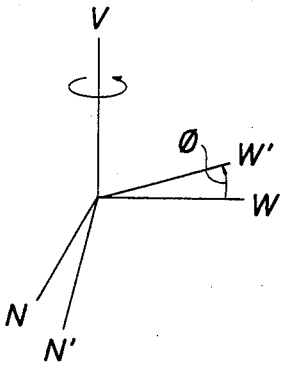

After the first rotation a second rotation is performed, as shown in FIG. 2B, around the vertical axis $\vec{V}$ to move the north and west directions into positions $\vec{N}'$ and $\vec{W}'$. This rotation is through the angle $\phi$ and can be represented by the following expressions:

Second Rotation:

$$\begin{pmatrix} \vec{N}' \\ \vec{W}' \\ \vec{V} \end{pmatrix} = \begin{pmatrix} \cos\phi & \sin\phi & 0 \\ -\sin\phi & \cos\phi & 0 \\ 0 & 0 & 1 \end{pmatrix} \cdot \begin{pmatrix} \vec{N} \\ \vec{W} \\ \vec{V} \end{pmatrix} = R_A \cdot \begin{pmatrix} \vec{N} \\ \vec{W} \\ \vec{V} \end{pmatrix} \quad (2)$$

where $\vec{N}'$ points toward the low side of the borehole, $\vec{W}'$ is mutually orthogonal to $\vec{N}'$ and $\vec{V}$, $\vec{V}$ is unchanged.

The angle $\phi$ is defined as $\phi = 180$-devazimuth, where devazimuth is the angle measured clockwise from north in the earth reference frame and is defined as the direction toward which the bottom of the borehole is deviating.

Figure 2C:
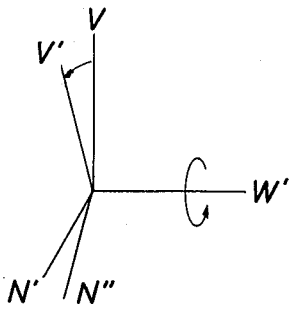

The final rotation is shown in FIG. 2C and is about new axis $\vec{W}'$ to provide two new axes, $\vec{V}'$ and $\vec{N}''$. This rotation is through the angle $\theta$ and is represented by the following expression:

Third Rotation:

$$\begin{pmatrix} \vec{N}'' \\ \vec{W}' \\ \vec{V}' \end{pmatrix} = \begin{pmatrix} \cos\theta & 0 & -\sin\theta \\ 0 & 1 & 0 \\ \sin\theta & 0 & \cos\theta \end{pmatrix} \cdot \begin{pmatrix} \vec{N}' \\ \vec{W}' \\ \vec{V} \end{pmatrix} = R_B \cdot \begin{pmatrix} \vec{N}' \\ \vec{W}' \\ \vec{P} \end{pmatrix} \quad (3)$$

where $\vec{N}''$ points toward the low side of the borehole and now lies in the plane of the borehole, $\vec{W}'$ lies in the plane of the borehole and is unchanged, $\vec{V}'$ lies along the axis of the borehole.

With the above rotations we can now write the following expressions:

$$\begin{pmatrix} \vec{N}'' \\ \vec{W}' \\ \vec{V}' \end{pmatrix} = R_M R_A R_B \begin{pmatrix} \vec{M} \\ \vec{W} \\ \vec{P} \end{pmatrix} \quad (4)$$

where $$R_M R_A R_B = \begin{pmatrix} a_{11} & a_{12} & a_{13} \\ a_{21} & a_{22} & a_{23} \\ a_{31} & a_{32} & a_{33} \end{pmatrix} = R \quad (5)$$

Also, $$\begin{pmatrix} \vec{M} \\ \vec{W} \\ \vec{P} \end{pmatrix} = R^{-1} \begin{pmatrix} \vec{N}'' \\ \vec{W}' \\ \vec{V}' \end{pmatrix} \quad (6)$$

-continued with $$R^{-1} = \begin{pmatrix} a_{11} & a_{21} & a_{31} \\ a_{12} & a_{22} & a_{32} \\ a_{13} & a_{23} & a_{33} \end{pmatrix}$$

From the above equations, it is seen that the magnetic vector $\vec{M}$ is equal to $$\vec{M} = \vec{N}''a_{11} + \vec{W}'a_{21} + \vec{V}'a_{31}$$

where $a_{11}$ $a_{21}$ $a_{31}$ are the direction cosines between $\vec{M}$ and $\vec{N}''$, $\vec{W}'$, and $\vec{V}'$, respectively.

Figure 3:
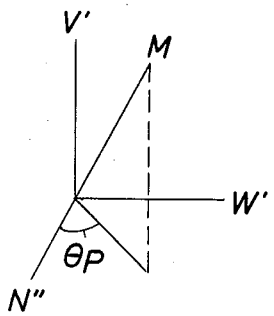
FIG. 3 illustrates a method for calculating the projection of the earth's magnetic field onto the plane of the BHTV.

As shown in FIG. 3, the value of $\theta_p$ which is the angular difference between the low side of the borehole and the projection of the earth's magnetic field on the plane of the BHTV can be easily determined from the following expression:

$$\theta_p = \arctan(\alpha_{21}/\alpha_{11}) \quad (8)$$

Having found the angular relationship of the magnetic vector projected into the borehole plane and the low side of the borehole in the borehole plane, the composite rotation matrix, $R_t$, from the earth reference frame to the bedding plane frame is derived. Both $R_A$ and $R_B$ have been derived in expressions (2) and (3), respectively. Using the results of expression (3) and rotating about the borehole axis $\vec{V}'$ as shown in FIG. 4A to move $\vec{N}''$ to $\vec{N}'''$, which points toward the low side of the bed or fracture, one obtains the following expression:

$$\begin{pmatrix} \vec{N}''' \\ \vec{W}'' \\ \vec{V}' \end{pmatrix} = R_c \begin{pmatrix} \vec{N}'' \\ \vec{W}' \\ \vec{V}' \end{pmatrix} \text{ where } R_c = \begin{pmatrix} \cos\gamma & \sin\gamma & 0 \\ -\sin\gamma & \cos\gamma & 0 \\ 0 & 0 & 1 \end{pmatrix} \quad (9)$$

where $\gamma$ is defined by the expression $\gamma = \theta_p$ less the apparent dip azimuth in the borehole plane. Thus $\gamma$ is the angle between the low side of the borehole and the low side of the bed or fracture and includes the magnetic inclination correction.

Figure 4A:
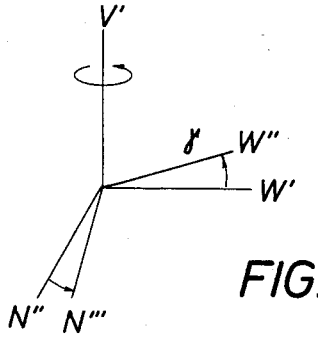
FIGS. 4A–4B represent an additional set of rotations for rotating the axes of the BHTV in the borehole to a set of axes in the bedding or fracture plane.
Figure 4B:
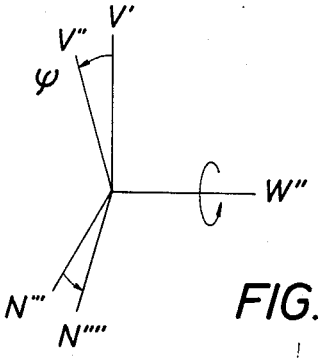

Next the system of FIG. 4A is rotated about the axis $\vec{W}''$ as shown in FIG. 4B to obtain the following expression:

$$\begin{pmatrix} \vec{N}'''' \\ \vec{W}'' \\ \vec{V}'' \end{pmatrix} = R_D \begin{pmatrix} \vec{N}''' \\ \vec{W}'' \\ \vec{V}' \end{pmatrix} \text{ where } R_D = \begin{pmatrix} \cos\psi & 0 & -\sin\psi \\ 0 & 1 & 0 \\ \sin\psi & 0 & \cos\psi \end{pmatrix} \quad (10)$$

where $\psi$ is the apparent dip in the borehole plane.

From expressions (2), (3), (9) and (10) one can obtain the following rotation matrix:

$$R_T = R_A \cdot R_B \cdot R_C \cdot R_D \quad (11)$$

that yields $$\begin{pmatrix} \vec{N}'''' \\ \vec{W}'' \\ \vec{V}'' \end{pmatrix} = R_T \begin{pmatrix} \vec{N} \\ \vec{W} \\ \vec{V} \end{pmatrix} \tag{12}$$

where $R_t$ is of the form $$R_t = \begin{pmatrix} A_{11} & A_{12} & A_{13} \\ A_{21} & A_{22} & A_{23} \\ A_{31} & A_{32} & A_{33} \end{pmatrix} \tag{13}$$

$R_t$ is in fact then the matrix of direction cosines, and yields specifically the results:

$$\begin{aligned} \vec{V}'' &= \vec{N}A_{31} + \vec{W}A_{32} + \vec{V}A_{33} \\ \vec{W}'' &= \vec{N}A_{21} + \vec{W}A_{22} + \vec{V}A_{23} \\ \vec{N}'''' &= \vec{N}A_{11} + \vec{W}A_{12} + \vec{V}A_{13} \end{aligned} \tag{14}$$

Since $\vec{V}''$ is now perpendicular to the bedding plane or fracture, $\vec{N}''''$ (FIG. 4B) lies in the plane and defines the dip direction while $\vec{W}''$ lies along the strike of the bedding or fracture plane. The true dip can be expressed as $$\text{True Dip} = \text{Arccos } A_{33} \tag{15}$$

since $A_{33}$ is the cosine between true vertical and the bed plane vector.

Figure 5:
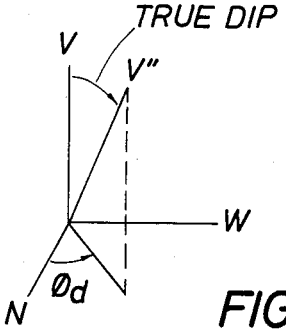
FIG. 5 illustrates a method for calculating the projection of the vector which is normal to the bedding or fracture plane onto the earth's reference plane to provide true dip azimuth.
Figures 6A, 6B:
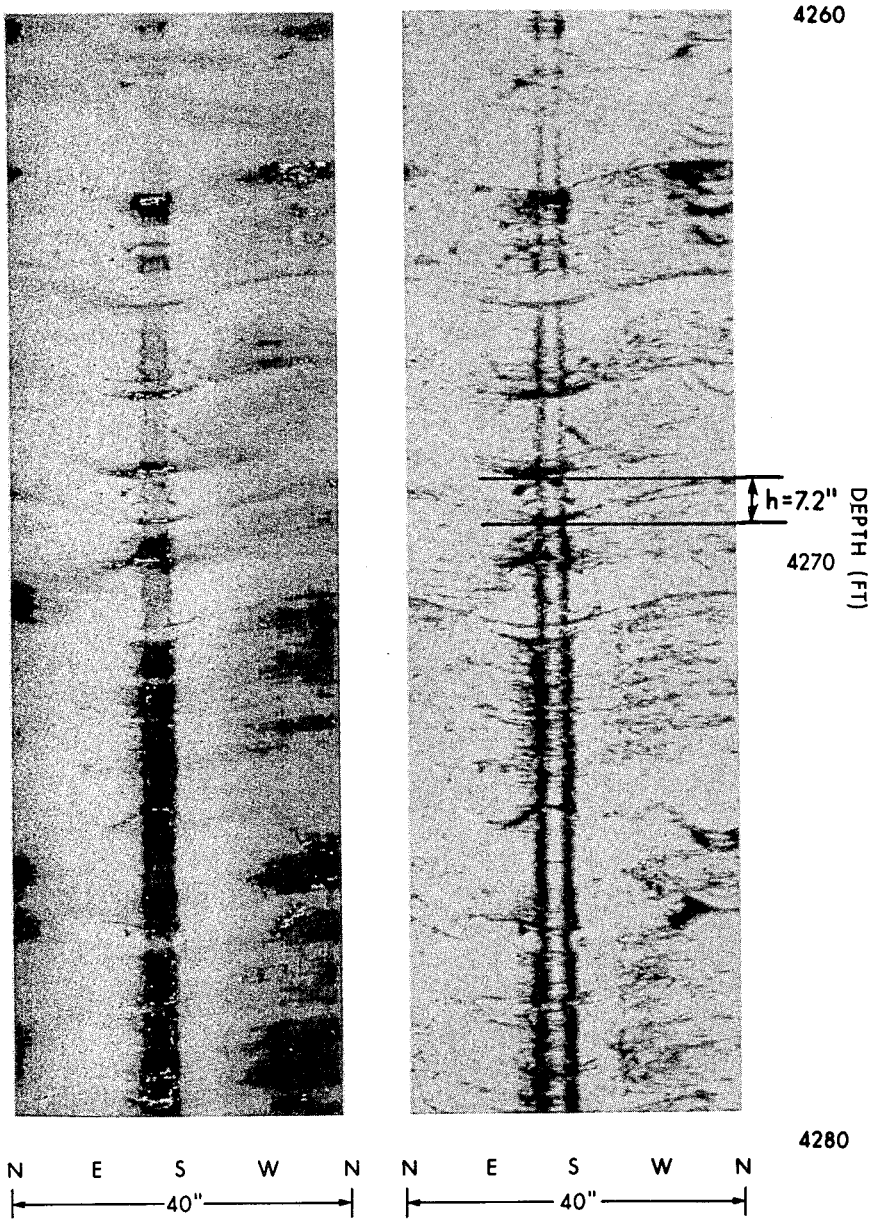
FIGS. 6A and 6B are a side-by-side example of a BHTV log showing a bedding plane.

Using the expression $$\vec{V}'' = \vec{N}A_{31} + \vec{W}A_{32} + \vec{V}A_{33} \tag{16}$$

one can determine the true dip azimuth from FIG. 5. From this $$\phi_d = \arctan (A_{32}/A_{31}) \tag{17}$$

which is the projection of the bedding or fracture plane normal vector $\vec{V}''$ onto the earth's reference plane which provides true dip azimuth pointing downdip.

Figure 7A:
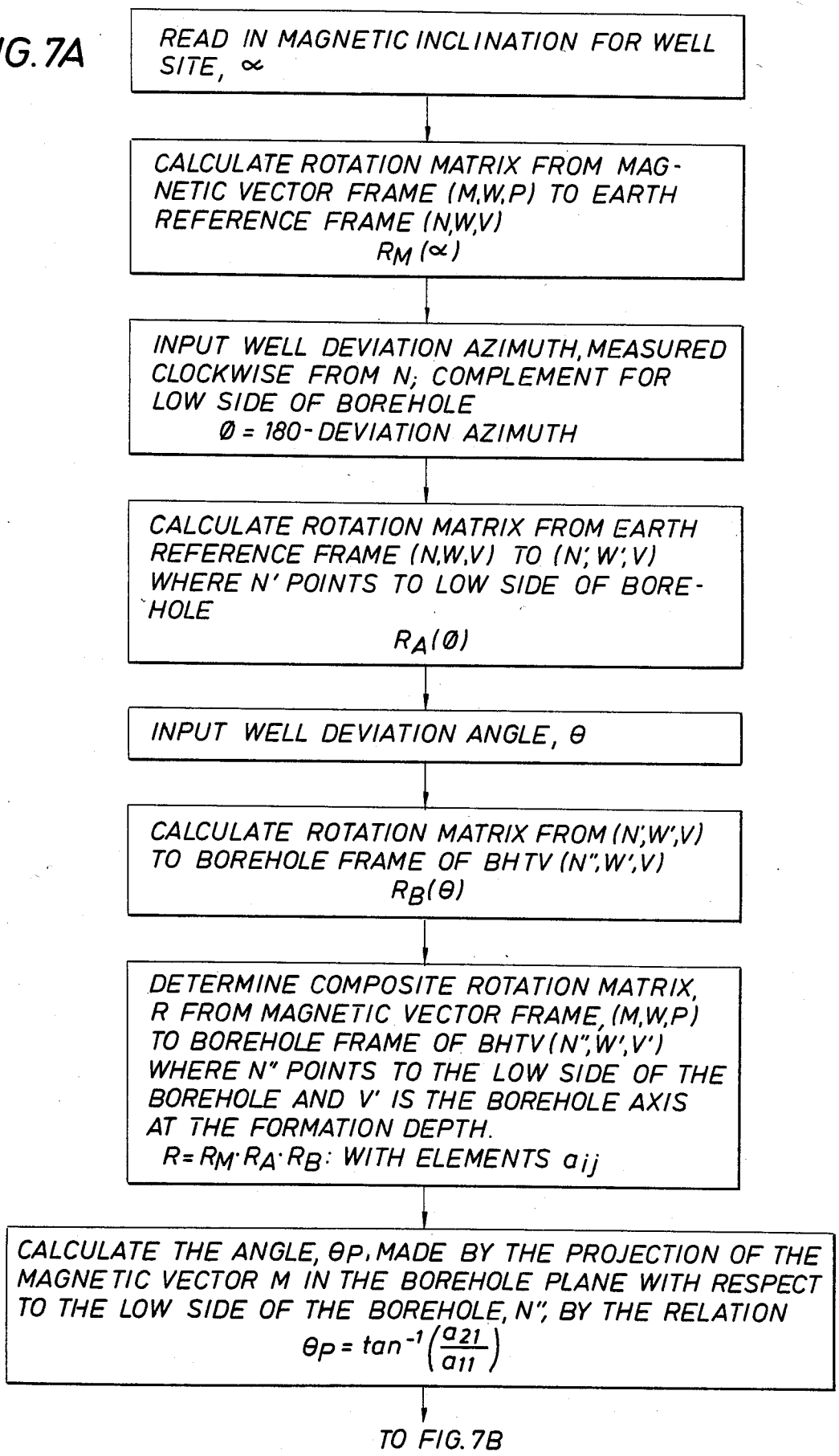

All of the above equations can of course be solved in a small computer, and if the computer is equipped with a display board and light pen the depth and apparent azimuth of the bedding plane can also be entered so that the computer outputs the true dip and azimuth of the bedding plane. A flow chart for a suitable computer program which can be used to compute these values is presented in FIG. 7.

As may be seen, therefore, the present invention has numerous advantages. Principally, it provides accurate information concerning the true dip and azimuth of formation bedding or fracture planes, correcting for the borehole deviation and the inclination of the earth's magnetic field. Also of great importance, the present invention is equally effective in boreholes containing non-conductive fluids, where an electrical dip meter would be ineffective. The invention can be easily and inexpensively implemented on readily available equipment to quickly and accurately furnish the desired information, and is thus readily suited to the widest possible utilization in logging earth formations penetrated by a borehole, and providing true dip and azimuth information heretofore unavailable.

While the methods herein described constitute preferred embodiments of this invention, it is to be understood that the invention is not limited to these precise methods, and that changes may be made therein without departing from the scope of the invention.

What is claimed is:

1. A method for determining the true dip and azimuth, in the earth's reference frame, of a bedding or fracture plane in a formation penetrated by a deviated borehole, comprising;

(a) obtaining a BHTV log of the formation, (b) determining, with respect to the earth's reference frame, the deviation and deviation azimuth of the portion of the borehole that penetrates the formation, (c) determining the earth's magnetic inclination in the vicinity of the borehole, (d) utilizing the BHTV log measurements to compute the dip and dip azimuth of the bedding or fracture plane in the borehole reference frame, and (e) at least in part by rotating the axes of the earth's reference frame to the axes of the BHTV in the borehole, and by utilizing the computed dip and dip azimuth of the bedding or fracture plane, the deviation and deviation azimuth of the borehole portion, and the earth's magnetic inclination, computing true dip and dip azimuth of the bedding or fracture plane in the earth's reference frame.

2. The method of claim 1 further comprising recording the BHTV log of the formation.

3. The method of claim 1 further comprising performing step (d) thereof independently of the conductivity of the fluid in the borehole.

4. The method of claim 3 further comprising obtaining the BHTV log in a borehole containing an oil-based mud.

5. The method of claim 1 wherein step (e) thereof further comprises performing a predetermined series of vector rotations to rotate the axes of the earth's reference frame to another set of orthogonal axes which include one axis lying along the strike of the bedding or fracture plane, one lying in the plane and defining the dip direction thereof, and one perpendicular to the plane.

6. The method of claim 1 wherein step (e) thereof further comprises:

(a) rotating the earth's magnetic vector $\vec{M}$ about the earth's west vector $\vec{W}$ to align it with the earth's north vector $\vec{N}$, (b) rotating the earth's north vector $\vec{N}$ around the earth's vertical vector $\vec{V}$ to point the north vector $\vec{N}$ in a new direction $\vec{N}'$ toward the low side of the borehole, and to define a new vector $\vec{W}'$ which is orthogonal to $\vec{V}$ and $\vec{N}'$ and lies in the plane of the borehole, and (c) rotating the vector $\vec{N}'$ around the vector $\vec{W}'$ to define a new vector $\vec{N}''$ which also lies in the plane of the borehole and which points toward the low side thereof, and to define a new vector $\vec{V}'$ which is orthogonal to $\vec{N}''$ and $\vec{W}'$ and lies along the axis of the borehole.

7. The method of claim 6 further comprising, from said rotations, determining the value of the angular difference between the low side of the borehole and the projection of the earth's magnetic field on the plane of the borehole.

8. The method of claim 6 further comprising:

(a) rotating the vector $\vec{N}''$ around the borehole axis V' to point in a new direction $\vec{N}'''$ which points toward the low side of the bed or fracture, corrected for magnetic inclination, and also moving the vector $\vec{W}'$ to a new vector $\vec{W}''$ which is orthogonal to $\vec{N}'''$ and $\vec{V}'$ and lies along the strike of the bedding or fracture plane, and (b) rotating the vector $\vec{N}'''$ around the vector $\vec{W}''$ to move N''' to the vector $\vec{N}''''$ which lies in the bedding or fracture plane and defines the dip direction thereof, and also moving the vector $\vec{V}'$ to a new vector $\vec{V}''$ which is perpendicular to the bedding or fracture plane.

9. The method of claim 8 further comprising, from said rotations, determining the values of the true dip and the true dip azimuth of the bedding or fracture plane.

10. The method of claim 9 wherein the true dip azimuth pointing downdip is determined as the projection of the bedding or fracture plane vector $\vec{V}''$ onto the earth's reference plane.

11. A method for determining the true dip and azimuth, in the earth's reference frame, of a bedding or fracture plane in a formation penetrated by a deviated borehole, comprising;

(a) obtaining and recording a centrallized BHTV log of the formation, (b) determining, with respect to the earth's reference frame, the deviation and deviation azimuth of the portion of the borehole that penetrates the formation, (c) determining the earth's magnetic inclination in the vicinity of the borehole, (d) utilizing the BHTV log measurements to compute the dip and dip azimuth of the bedding or fracture plane in the borehole reference frame independently of the conductivity of the fluid in the borehole, (e) utilizing the computed dip and dip azimuth of the bedding or fracture plane, the deviation and deviation azimuth of the borehole portion, and the earth's magnetic inclination to compute true dip and dip azimuth of the bedding or fracture plane in the earth's reference frame by:

(i) rotating the earth's magnetic vector $\vec{M}$ about the earth's west vector $\vec{W}$ to align it with the earth's north vector $\vec{N}$, (ii) rotating the earth's north vector $\vec{N}$ around the earth's vertical vector $\vec{V}$ to point the north vector $\vec{N}$ in a new direction $\vec{N}'$ toward the low side of the borehole, and to define a new vector $\vec{W}'$ which is orthogonal to $\vec{V}$ and $\vec{N}'$ and lies in the plane of the borehole, (iii) rotating the vector $\vec{N}'$ around the vector $\vec{W}'$ to define a new vector $\vec{N}''$ which also lies in the plane of the borehole and which points toward the low side thereof, and to define a new vector $\vec{V}'$ which is orthogonal to $\vec{N}''$ and $\vec{W}'$ and lies along the axis of the borehole, (iv) rotating the vector $\vec{N}''$ around the borehole axis $\vec{V}'$ to point in a new direction $\vec{N}'''$ which points toward the low side of the bed or fracture, corrected for magnetic inclination, and also moving the vector $\vec{W}'$ to a new vector $\vec{W}''$ which is orthogonal to $\vec{N}'''$ and $\vec{V}'$ and lies along the strike of the bedding or fracture plane, and (v) rotating the vector $\vec{N}'''$ around the vector $\vec{W}''$ to move $\vec{N}'''$ to the vector $\vec{N}''''$ which lies in the bedding or fracture plane and defines the dip direction thereof, and also moving the vector $\vec{V}'$ to a new vector $\vec{V}''$ which is perpendicular to the bedding or fracture plane, and (f) from said rotations, determining the value of the angular difference between the low side of the borehole and the projection of the earth's magnetic field on the plane of the borehole, and determining the values of the true dip and the true dip azimuth of the bedding or fracture plane, the true dip azimuth pointing downdip being determined as the projection of the bedding or fracture plane vector $\vec{V}''$ onto the earth's reference plane.

* * * * *